US006773035B1

(12) United States Patent
Cox et al.

(10) Patent No.: US 6,773,035 B1
(45) Date of Patent: Aug. 10, 2004

(54) INTEGRATED PLASTICIZED CARD IN A PAPER CARRIER AND METHOD OF MANUFACTURE

(75) Inventors: Christopher Robert Cox, Orangeville (CA); Thomas MacDonald, Toronto (CA); Thomas Carrigan, Scarborough (CA); William Dale Ritchie, Richmond (CA)

(73) Assignee: Relizon Canada Inc., Boucherville (CA)

( * ) Notice: Subject to any disclaimer, the term of this patent is extended or adjusted under 35 U.S.C. 154(b) by 0 days.

(21) Appl. No.: 09/684,129

(22) Filed: Oct. 10, 2000

(51) Int. Cl.[7] ..... B42D 15/00

(52) U.S. Cl. ..... 283/61; 283/81; 283/101; 283/105; 283/106; 283/107; 428/40.1; 428/42.1; 428/43

(58) Field of Search ..... 283/61, 62, 74, 283/75, 81, 82, 94, 98, 101, 105, 106, 107; 428/40.1, 41.7, 42.1, 42.2, 42.3, 43

(56) References Cited

U.S. PATENT DOCUMENTS 5,131,686 A 7/1992 Carlson
5,509,693 A * 4/1996 Kohls ..... 283/75
5,529,345 A * 6/1996 Kohls ..... 283/101
5,842,722 A * 12/1998 Carlson ..... 283/107
5,895,074 A * 4/1999 Chess et al. ..... 283/107
6,022,051 A * 2/2000 Casagrande ..... 283/107
6,039,356 A * 3/2000 Warther et al. ..... 283/61
6,159,570 A * 12/2000 Ulrich et al. ..... 283/109
6,179,201 B1 * 1/2001 Chess ..... 229/92.1
6,224,109 B1 * 5/2001 Yang ..... 283/57
6,306,475 B1 * 10/2001 Stocq et al. ..... 428/345
6,322,655 B1 * 11/2001 Casagrande ..... 156/257

* cited by examiner

*Primary Examiner*—Monica S. Carter
(74) *Attorney, Agent, or Firm*—Jacobson Holman PLLC

(57) ABSTRACT

A carrier sheet with an integrated card and preferably, but not exclusively, a magnetic strip card is described. The sheet contains printed information which is in part card information printed at a predetermined location on a front face of a carrier sheet in a card region thereof and oriented to be disposed on an outer surface of the front and a rear card panel of the card to be formed. The siliconized liner patch, containing a pressure-sensitive adhesive, is laminated on the back surface of the carrier sheet and disposed to extend over the card region. A face patch of clear poly material containing a magnetic strip is removably secured over the card region on the front face of the paper carrier sheet. A die cut delineates card contour panels and a straight fold line separates the panel whereby they may be folded together when detached from the carrier sheet with the pressure-sensitive adhesive of the liner being transferred to the rear surface of the panels so that the panels can be folded together with their rear surface stuck together. The method of manufacture and a method of use is also described herein.

15 Claims, 4 Drawing Sheets

INTEGRATED PLASTICIZED CARD IN A PAPER CARRIER AND METHOD OF MANUFACTURE

TECHNICAL FIELD

The present invention relates to a carrier sheet form having an integrated card having opposed plasticized surfaces and preferably, but not exclusively, a magnetic strip card, and the method of manufacture and use.

BACKGROUND ART

It is known to provide carrier sheets having detachable cards printed thereon with the contour of the card being die cut and retained in the sheet or form by friction or uncut regions about the card. As discussed in U.S. Pat. No. 5,131,686 is it also known to manufacture identification cards produced as embossed plastic cards and plain paper cards. However, embossed cards are relatively expensive to make, while plain paper cards are inexpensive. The problem with paper cards is that they are not long lasting and do not convey a polished image on their outer surface. The image can be chipped off paper fibers and these cards are not water resistant.

To make plastic cards, it is necessary to utilize plastic-coated paper and these are produced on an impact printer and the printing has relatively poor quality and are unable to form quality bar codes and graphics on such cards. Plastic sheets are also environmentally wasteful as most of the sheet is not utilized after the card is detached and they are also costly and produce a recycling problem. Often, these cards also fall off the carrier sheets. Paper-handling machines and printers have problems with handling sheets of uneven thickness, such as sheets carrying cards and portions thereof and often will jam in the machine resulting in costly maintenance and destruction of the paper stock. This is much more serious if the printing consists of personalized information as this would require resetting the machine and the computer and analyzing the printed forms to determine which have to be destroyed. In summary, previous attempts have been made using laser or ionographic printers and have failed to produce acceptable carrier sheets bearing plastic die cut identification cards.

In an attempt to remedy this problem, U.S. Pat. No. 5,131,686 discloses a method and a sheet stock wherein the layer of printable plastic is adhered to a portion of an upper surface of a sheet and a second layer of paper or plastic is adhered over the remainder portion of the upper surface of the sheet, whereby the sheet is of substantially uniform thickness and can be handled in a printing process of the laser type, ionographic or ink jet type. However, this method is costly due to the fact that another sheet needs to be adhered to the large remaining portion of the carrier sheet.

SUMMARY OF INVENTION

It is a feature of the present invention to provide a carrier sheet with an integrated printed card having opposed plasticized surfaces and preferably, but not exclusively, a magnetic strip card, and which substantially overcomes the above-mentioned disadvantages of the prior art.

Another feature of the present invention is to provide a method of forming a carrier sheet having an integrated detachable magnetic strip card having opposed plasticized surfaces and which substantially overcomes the above-mentioned disadvantages of the prior art.

Another feature of the present invention is to provide a novel method of booking a travel event using a carrier sheet with an integrated magnetic strip card having a user code encoded on the magnetic strip and wherein the carrier sheet contains personal printed information.

Another feature of the present invention is to provide a carrier sheet having an integrated magnetic strip card formed by two plasticized panels containing printed information and a magnetic strip and an adhesive backing wherein when said panels are detached from said sheets and folded on a straight interconnecting fold line, said panels are juxtaposed at their rear surface and glued together, whereby said card is plasticized on the front and rear surface thereof.

According to the above features, from a broad aspect, the present invention provides a carrier sheet with an integrated card. The carrier sheet has printed information thereon. The printed information contains in part card information printed at a predetermined location on a front face of the carrier sheet in a card region of the sheet and oriented to be disposed on an outer surface of a front and a rear card panel of a card to be formed. A siliconized liner patch, containing a pressure-sensitive adhesive surface, is laminated on a back surface of the carrier sheet and disposed to extend over the card region. A face patch of clear poly material is immovably secured over the card region on the front face of the carrier sheet. A die cut delineates the front and rear panels disposed adjacent one another and extends through the face patch and carrier sheet. The die cut card panels are retained in the carrier sheet by the pressure-sensitive adhesive of the siliconized liner patch. A straight fold line is formed in the face patch to form a fold line between the front and rear card panels. The card is formable by peeling off the front and rear card panels from the carrier sheet with the pressure-sensitive adhesive releasing from the siliconized liner patch whereby the adhesive now lies on a back face of the front and rear card panels. The panels are folded along the straight fold line to secure the back face of the panels containing the adhesive together.

According to a further broad aspect of the present invention, there is a provided a method of forming a carrier sheet having an integrated detachable card. The method comprises the steps of printing a carrier sheet with information containing in part card information printed at a predetermined location on the front face of the carrier sheet in a card region of the carrier sheet and oriented to be disposed on an outer surface of the front and a rear card panel of a magnetic strip card to be formed. A siliconized liner patch, containing a pressure-sensitive adhesive surface, is applied on a back surface of the carrier sheet and attached by said adhesive to extend over the card region. A face patch of clear poly material containing a magnetic strip is secured over the card region on the front face of the carrier sheet. The front and rear card panels are then die cut about their peripheries. The die cut extends through the face patch and the carrier sheet, whereby the die cut card panels are adjacent one another and solely retained in the carrier sheet by the pressure-sensitive adhesive on the siliconized liner patch on the back surface of the carrier sheet. When detached, the panels are folded along a straight fold line which is formed in the face patch between the adjacent front and rear card panels, whereby to permit the adjacent card panels to be folded and stuck together on their back faces along the fold line when adjacent die cut card panels are pulled off the silicone liner patch and carry the pressure-sensitive adhesive on their back surface.

According to a still further broad aspect of the present invention, there is provided a method of booking a travel event comprising receiving a customer identity and a personal event request. The customer identity information and an event schedule information customized to the request is stored in a computer. A carrier sheet containing an integral magnetic strip card is automatically addressed to the customer and the magnetic strip card is encoded with a user code to access the stored information at an event location. The carrier sheet with the integral magnetic strip card which has been encoded is then forwarded to the customer who detaches the card. The customer enters the card in a magnetic strip card reader at the event location whereby the stored information is automatically accessed by identifying the user code to record the arrival of the customer at the event location and automatically print additional personalized information that may be available to the customer only at the event location for use by the customer.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 4:
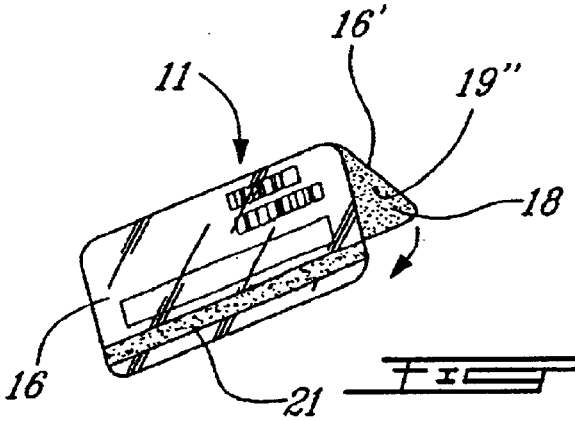
FIG. 4 is a perspective view showing how the card panels are folded together to form a plasticized card.

Referring now to the drawings and more particularly to FIGS. 1 and 6 through 8 there is shown a carrier sheet 10, which could be formed of paper or suitable synthetic material, and having an integrated magnetic strip card 11, herein two cards 11 and 11' formed integral with the carrier sheet 10. The carrier sheet has printed information 12 printed thereon as well as card information 13 printed thereon at a predetermined card location on the front face 14 of the carrier sheet. The lower portion of the carrier sheet is a card region 20 and the printed information 13 is oriented to be disposed on an outer surface 15 of a front and rear panel 16 and 16' respectively which forms the magnetic strip card 11 and as more clearly shown in FIG. 5 after the panels are folded together as also shown in FIG. 4.

Figure 6:
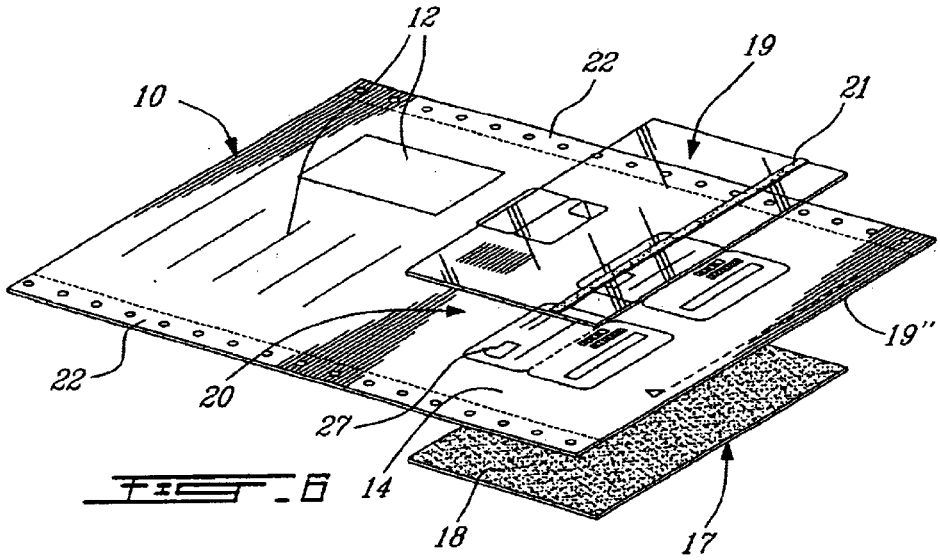
FIG. 6 is a partly exploded perspective view showing the construction of the carrier sheet with two integrated magnetic strip cards being formed thereon.
Figure 7:
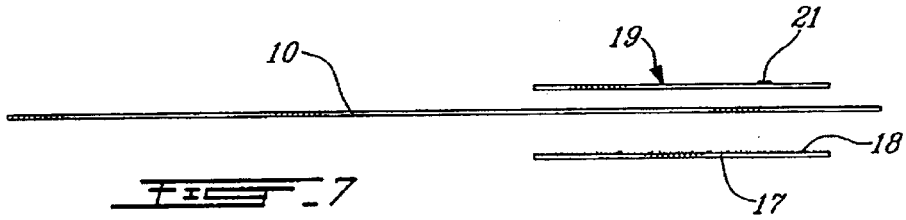
FIG. 7 is a side view of FIG. 6 showing the location of the patches relative to the carrier sheet.
Figure 8:
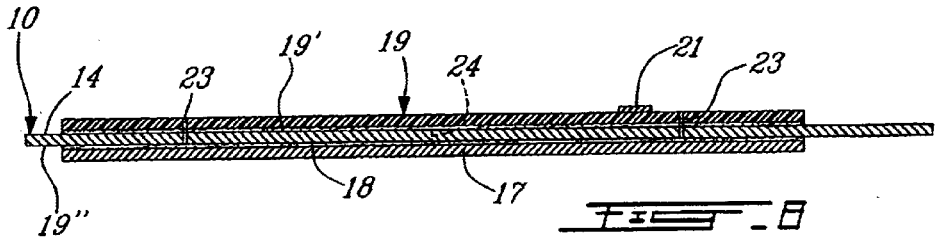
FIG. 8 is an exaggerated section view showing the component parts of the carrier sheet with the integrated magnetic strip card and its die cut.

As shown more clearly in FIGS. 6 to 8, a siliconized liner patch 17 containing a pressure-sensitive adhesive 18 on a surface thereof is laminated on the back surface 19 of the carrier sheet 10 with the adhesive placed on the back surface of the carrier sheet and disposed to extend over the card region 20.

Figure 1:
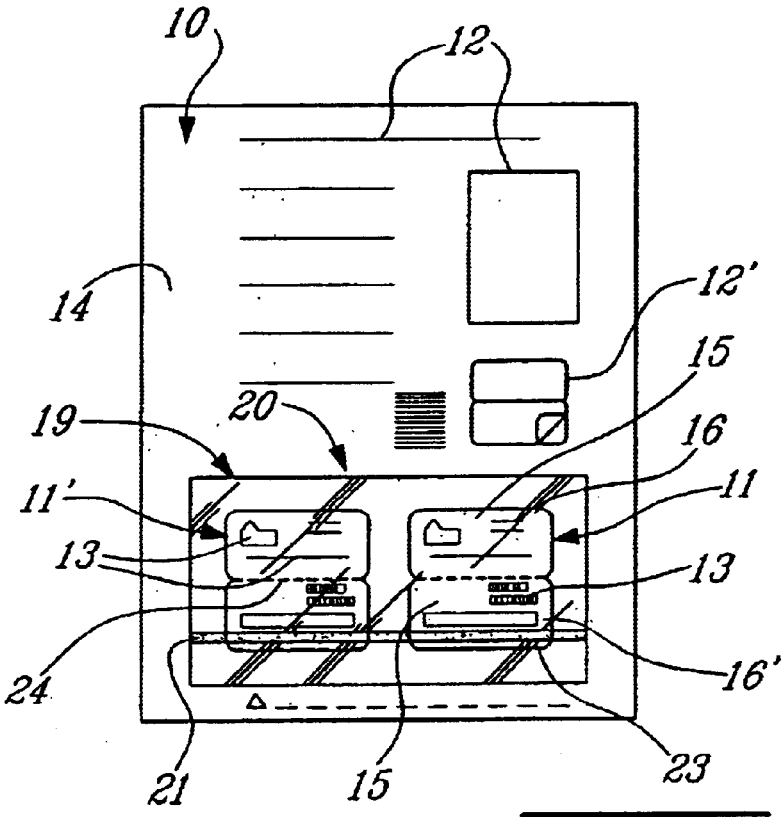
FIG. 1 is a plan view showing a carrier sheet with an integrated magnetic strip card and constructed in accordance with the present invention.

A face patch 19 of clear poly material, such as polyester, polystyrene, etc., containing a magnetic strip 21 is removably secured over the front face 14 of the carrier sheet 10 and the card region 20 with the magnetic strip 21 oriented across the rear panel 16' to be formed at a specific location thereon. As shown in FIG. 1, the magnetic strip 21 extends across both rear card panels 16' and entirely across the face patch 19. The face patch may be adhered to the carrier sheet by a hot press or a transparent adhesive whereby it is laminated on the carrier sheet. It is pointed out that both the patches 17 and 19 are very thin films capable of withstanding temperatures of 340° F. to 450° F., as well as the magnetic strip, and do not cause any interference when handled by a printing press or a patch-applying laminating machine. They are also handled in an interference-free manner in laser printers associated with personal PCs. Accordingly, the plastic film is of a type capable to be printed in a laser printer. It is pointed out that the composite carrier sheet can be computer printed using simplex printing (laser, thermal or impact).

The carrier sheet 10 as shown in FIG. 6 is further provided with opposed detachable perforated carrier strips 22 for feeding the carrier sheet or form in a high-speed printer and a high-speed-patch applicating and butterfly die cutting machine of the type known in the art. Alternatively, the carrier sheet may be part of a paper roll and wherein indexing markings may be provided on the sheet for synchronous processing in a high-speed printer, patch applicator, die cutting and paper- severing-machine process.

After the patches 17,19 have been laminated on the carrier sheet 10, the sheet undergoes a die cutting process, whereby a butterfly die cut 23 delineates the front and rear card panels disposed adjacent one another, as better shown in FIG. 1, and extends through the face patch 20, the magnetic strip 21 which extends beyond the side edges of the rear card panel 16' and the carrier sheet 10, as better illustrated in FIG. 8. It is pointed out that in FIG. 8 the patches and the carrier sheet as well as the magnetic strips are exaggerated in thickness for ease of illustration and description but as earlier mentioned, these patches as well as the magnetic strips are thin film products. It is also pointed out that the butterfly-type die cut card panels 16 and 16' are retained in the carrier sheet 10 by the pressure-sensitive adhesive 18 which is now transferred to the back surface 19 of the carrier sheet due to pressure having been applied during the printing and patch application process. A straight perforation line 24 is formed in the face patch to form a fold line between the front and rear panels 16 and 16' as better illustrated in FIG. 1.

Figure 2:
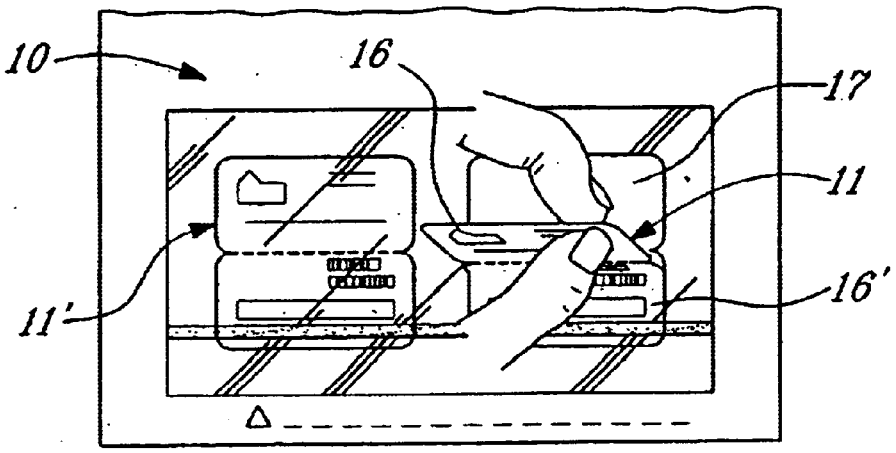
FIG. 2 is a fragmented partly perspective view showing how the card panels are detached from the carrier sheet.
Figure 3:
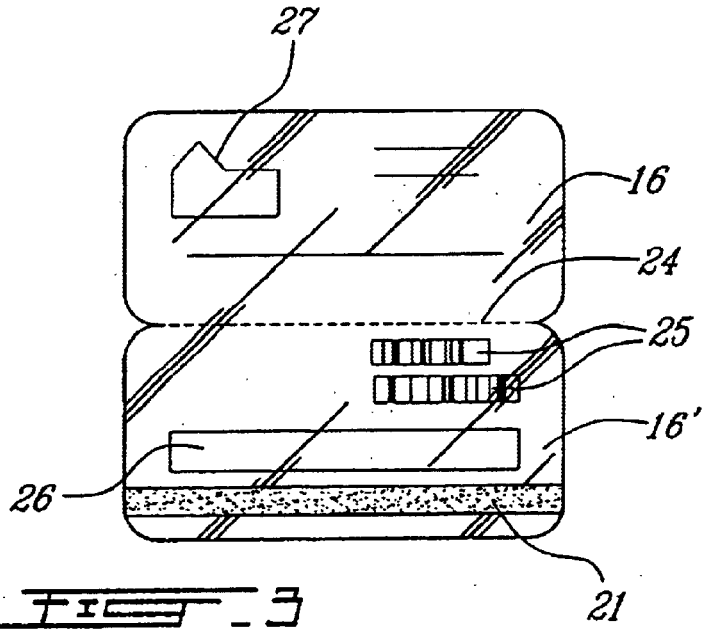
FIG. 3 is a plan view showing the card panels detached from the carrier sheet.
Figure 5:
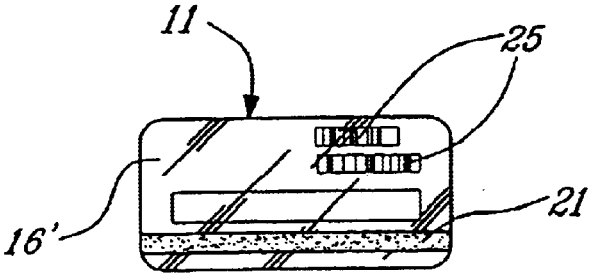
FIG. 5 is a plan view of the plasticized magnetic strip card formed in accordance with the present invention.

Referring now to FIGS. 2 to 5, there is illustrated the method of forming the magnetic strip card 11 and this is accomplished by detaching the front and rear card panels 16 and 16' in the manner as illustrated in FIG. 2 by grasping a corner of the panel and peeling it off the carrier sheet 10 with the pressure-sensitive adhesive 18 having now been stuck on the back surface 19 of the carrier sheet which forms the back face of the card panels. This pressure-sensitive adhesive simply releases from the silicone backing patch as its adherence with the adhesive is minimal as compared to the paper surface. The card panels having now been detached, as shown in FIG. 3, can now be folded on the fold line 24 to position their back adhesive surface juxtaposed to create a permanent bond as illustrated in FIGS. 4 and 5. Accordingly there is now formed a magnetic strip card having a plasticized surface on both sides of the card.

As also illustrated in FIGS. 3 to 5, the printed information on the card surface, herein the rear card panel 16', may include one or more bar codes 25 which may be used to identify the intended user of the card or for various other uses. It is also pointed out that the magnetic strip 21 is compatible for use in an encoder/reader machine to be encoded or read or both read and encoded. A window area 26 may also be printed on the rear panel to receive the signature of the card user person. On the front panel 16 there is usually printed graphics 27 which is customized to the card issuer. The information 12 printed on the carrier sheet may also contain personalized information as well as instructional information shown at 12' instructing the user how to form the plasticized magnetic strip card 11 of the present invention. As earlier described, the carrier sheet 10 as hereinshown contains two of these front and rear panels disposed in side-by-side relationship with the magnetic strip 21 oriented across both of the rear card panels 16'.

Figure 9:
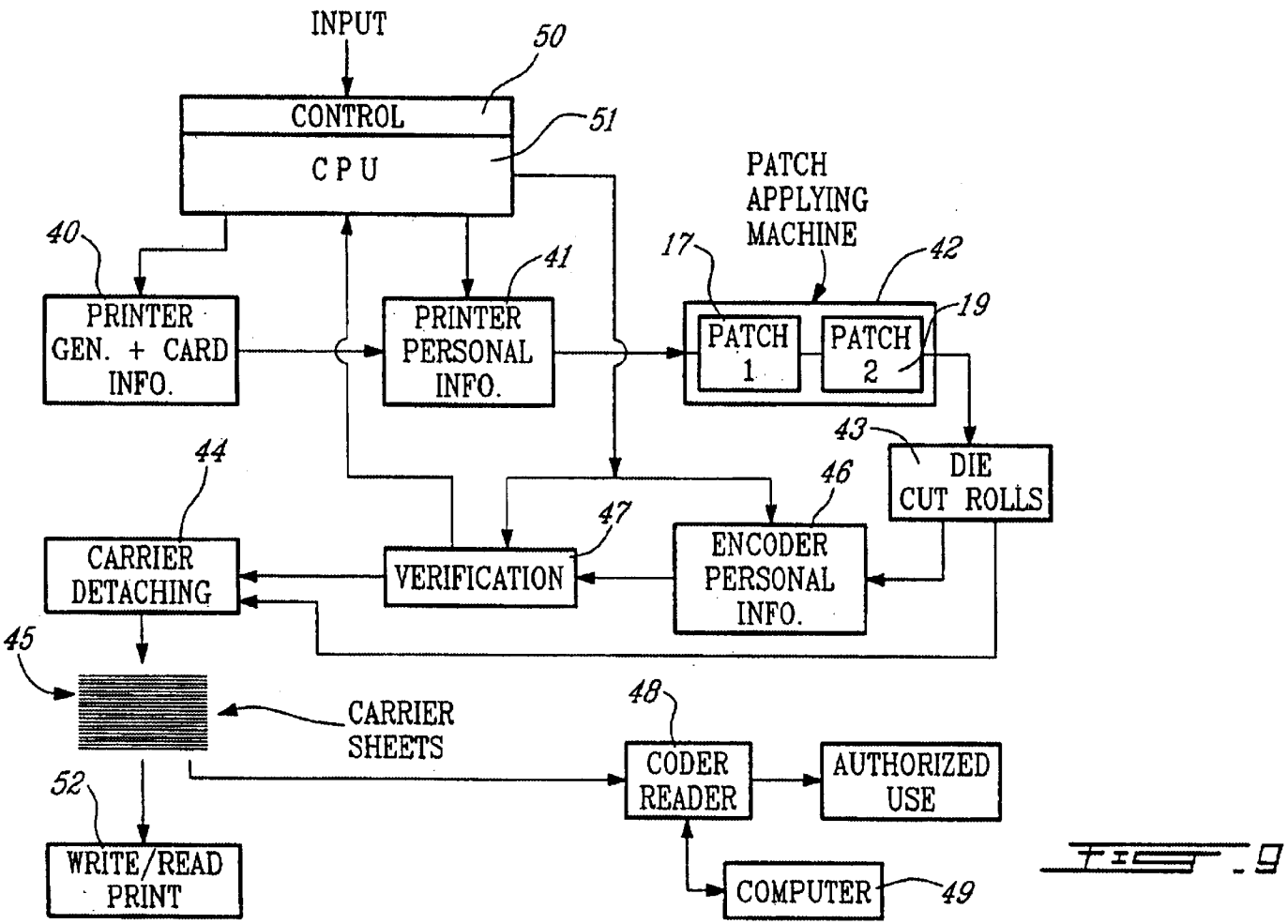
FIG. 9 is a block diagram of a computer control system for the fabrication of the carrier sheet with an integrated magnetic strip card, as well as the printing and encoding of personal information on the carrier sheet and the magnetic strip or simply the production of a carrier sheet with an integrated card or a magnetic strip card which is later automatically encoded for specific use.

With reference now to FIG. 9, there will be disclosed the method of forming the carrier sheet with the integrated detachable magnetic strip card as well as a method of use of the card. In an automated system, it is conceivable that a computer can control the entire manufacturing process. The method comprises printing on the carrier sheet 10 with information 12 containing in part card information printed at a predetermined location on the front face 14 of the carrier sheet and in a card region 20 of the carrier sheet with the printed information oriented to be disposed on an outer surface 15 of the front and rear card panel 16 and 16' respectively of the magnetic strip card to be formed. As shown in FIG. 9, the carrier sheet form 10 may be printed in a printer 40 which is controlled by a control device 50 which includes a computer programmable unit 51 providing a message to be printed on the carrier sheet as well as the disposition of the printed material. Any personalized information contained within the CPU is also printed at a designated location on the carrier sheet by the printer 40. This may be done in a different printing step as shown at 41 in another printer section. After the carrier sheet is printed with the general as well as personalized information, graphics, and bar codes, etc., the patches 17 and 19 are applied to the carrier sheet by a patch applying machine 42. The carrier sheet with the patches laminated thereto are then fed between a die cut roll 43 where the card panel outlines, having butterfly-type cut sections, is die cut into the form to delineate the card panels. This process can then be fed directly to a carrier detaching mechanism 44 wherein the carrier sheets with the integrated detachable magnetic strip card are released into a stack form 45. Alternatively, after the die cut roll, the form may be fed into an encoder 46 wherein a used code, as well as other personalized information, is encoded into the strip. The carrier sheet can then be fed to a verification reader device 47 to verify all of the information on the form with the CPU 51. The carrier sheet form is then fed to the carrier detaching machine 44.

The stack of carrier sheets 45, with uncoded magnetic strips and unpersonalized information on the card, can then be forwarded to intended users wherein the card can then be utilized in a coding machine 48 whereby an encrypted code can be encoded to the magnetic strip to provide authorized use of the card. The coding machine 48 is connected to the central computer 49 of the card issuer. Alternatively, the personalized carrier sheets including an encoded message in the magnetic strip can be forwarded to the intended user and placed into a write/read/print machine 52 for automatic processing.

It is further pointed out that the carrier sheet may contain printed information which is impersonalized and a customer would then print personalized information in designated areas for his customized use.

EXAMPLE 1

A typical example of the use of the carrier sheet and integrated magnetic strip card of the present invention is for the travel industry and particularly for the booking of cruises. For example, when a person books a cruise through a cruiseline or a travel agent, his/her personal information concerning its identity, as well as personal event request is stored in a computer such as the CPU 51 shown in FIG. 9. The event schedule information, as well as the customer identity information makes it possible for the CPU to print the customer identity information onto the carrier sheet in the printer 40, as well as other personal information, such as the person's name which could appear on the card panels. The panels may be printed in the printer 41. The magnetic strip is then encoded in the encoder 46 with a user code as well as other coded information which could be generated depending on the event schedule information stored in the computer. The user code will permit the user to access the stored computer information at an event location. The carrier sheet and the integral magnetic strip card is forwarded to the customer or end user who detaches the card from the carrier sheet in the fashion as previously described. The customer thus possesses one or two or more customized and plasticized magnetic strip cards and when arriving at the scheduled event, such as a port of departure of a cruise ship, the customer enters his personalized card in a magnetic strip card reader such as the write/read laser printer system 52 or a coder reader such as 48, and the user code provides access to the central computer 49 or 51 of the cruiseline to download to the user information concerning the specific room that he/she has been assigned on the ship, and the location of the room and other information. Simultaneously, the computer could also code the magnetic strip to activate the card so that the card user may use the card throughout the paying events on the cruiseliner for automatic billing by the computer system. The card also records the arrival of the customer at the event location so that the computer system can automatically effect the management of all bookings. This greatly facilitates the handling of the customers which is usually time consuming as large numbers of customers must be processed before a ship can depart from the harbour. The ships often contain 2000 to 4000 passengers and it could take as long as eight to twelve hours to process that many people. With this computer system, the processing would be done virtually automatically and practically error free.

EXAMPLE 2

In another embodiment, cards without magnetic strips in the patch may be integrally formed with the carrier sheet. For example, a telephone company could issue a card to a person with the person's name appearing on the card together with a personal access code. The carrier sheet contains instructions for using the card together with a toll-free telephone number, wherein the person receiving the card may dial the telephone number to activate the card by the personal access code and the person's pin number. The card can then be sent to someone you want to receive a call from at your expense and at a lower rate depending on the applicable time that the call is made. Such a system would provide to the card holder, the enjoyment of pre-paid long distance rate. The telephone company could offer the best available savings based on your long-distance savings plan and have no call connection fees for calls made from within a country without the assistance of an operator. You can also receive overseas calls with the assistance service by dialing an 800 number with no risk of call blocking.

The above examples are only to indicate a few uses of the carrier sheet with integrated card and there are countless other uses imaginable.

It is within the ambit of the present invention to cover any obvious modifications of the preferred embodiment described therein, provided such modifications fall within the scope of the appended claims.

We claim:

1. A carrier sheet with an integrated card, said carrier sheet having printed information thereon, said printed information containing in part card information printed at a predetermined location on a front face of said carrier sheet in a card region of said sheet and oriented to be disposed on an outer surface of a front and a rear card panel of a card to be formed, a siliconized liner patch containing a pressure-sensitive adhesive surface is laminated on a back surface of said carrier sheet and disposed to extend over said card region, a face patch of clear poly material is immovably secured over said card region on said front face of said carrier sheet, a die cut delineates said front and rear card panels disposed adjacent one another and extends through said face patch, and said carrier sheet; said die cut card panels being retained in said carrier sheet by said pressure sensitive adhesive of said siliconized liner patch, and a straight fold line in said face patch between said front and rear card panels, said card being formable by peeling off said front and rear card panels from said carrier sheet with said pressure-sensitive adhesive releasing from said siliconized liner patch whereby said adhesive now lies on a back face of said front and rear card panels, and folding said panels along said straight fold line to mate said back face of said panels containing said pressure-sensitive adhesive together.

2. A carrier sheet with an integrated card as claimed in claim 1 wherein said card is a magnetic strip card and wherein said face patch contains a magnetic strip which is oriented across one of the card panels, said die-cut extending through said magnetic strip at opposed edges of said card.

3. A carrier sheet with an integrated magnetic strip as claimed in claim 2 wherein said magnetic strip is oriented on said rear panel and disposed spaced and parallel to a lower edge of said rear panel.

4. A carrier sheet with an integrated magnetic strip as claimed in claim 2 wherein said carrier sheet is a paper printed form having opposed detachable perforated carrier strips for feeding same in a high speed printer and patch applicating and a butterfly die cutting machine.

5. A carrier sheet with an integrated magnetic strip as claimed in claim 2 wherein said printed information on said rear panel includes one or more bar codes for containing specific coded information, said magnetic strip being compatible for use in an encoder/reader machine to be encoded or read r both read and encoded.

6. A carrier sheet with an integrated magnetic strip as claimed in claim 5 wherein said bar codes or said magnetic strip contains personalized information, said printed information on said carrier sheet including personalized and instruction information, said magnetic strip being an encoded magnetic strip.

7. A carrier sheet with an integrated card as claimed in claim 1 wherein there are two of said front and rear card panels disposed in said card region of said carrier sheet and disposed spaced in side-by-side relationship, said magnetic strip being oriented across a common one of said panels.

8. A method of forming a carrier sheet having an integrated detachable card, said method comprising the steps of:

i. printing a carrier sheet with information containing in part card information printed at a predetermined location on a front face of said carrier sheet in a card region of said carrier sheet and oriented to be disposed on an outer surface of a front and rear card panel of a card to be formed, ii. applying a siliconized liner patch containing a pressure-sensitive adhesive surface on a back surface of said carrier sheet and attached by said adhesive to extend over said card region, iii. securing a face patch of clear poly material over said card region on said front face of said carrier sheet, iv. die cutting said front and rear card panels in said card region, said die cut extending through said face patch and said carrier sheet whereby said die cut card adjacent one another are solely retained in said carrier sheet by said pressure sensitive adhesive on said siliconized liner patch on said back surface of said sheet, and v. forming a straight fold line in said face patch between said adjacent front and rear card panels to permit said adjacent card panels to be folded together on their back faces along said fold line when said adjacent die cut card panels are peeled off said siliconized liner patch with the pressure-sensitive adhesive on their back surface.

9. A method of forming a carrier sheet having an integrated detachable card as claimed in claim 8 wherein said detachable card is a magnetic strip card, said step (iii) comprising positioning said patch with said magnetic strip oriented across one of said panels, said step (iv) including cutting said magnetic strip simultaneously with said patch and carrier sheet.

10. A method of forming a carrier sheet having an integrated detachable card as claimed in claim 8 wherein said step (iv) comprises die cutting two of said adjacent card panels sand disposed spaced in side-by-side relationship, said die-cut being a butterfly die-cut, said step (iii) including orienting said magnetic strip across a common one of said panels of said two adjacent panels and heat sealing said face patch on said card region.

11. A method of forming a carrier sheet having an integrated detachable card as claimed in claim 8 wherein said step (i) further includes the step of printing one or more bar codes containing specific coded information on said front face of one of said front and rear card panels.

12. A method of forming a carrier sheet having an integrated detachable card as claimed in claim 8 wherein there is further provided before step (i) inputting personalized data in a computer programmable unit whereby said step (i) comprises printing personalized information.

13. A method of forming a carrier sheet having an integrated detachable magnetic strip card as claimed in claim 9 wherein there is further provided the step of encoding said magnetic strip with personalized information and verifying said personalized information.

14. A method of forming a carrier sheet having an integrated detachable card as claimed in claim 8 wherein said carrier sheet is one series of form carrier sheets and wherein prior to step (i) there is provided the step of feeding said form carrier sheets in a high speed printing machine by means of opposed perforated detachable carrier strips and then feeding said printed form carrier sheets through a patch application machine and then an encoding machine.

15. A carrier sheet with an integrated machine strip card, said carrier sheet having printed information thereon, said printed information containing in part card information printed at a predetermined location on a front face of said sheet in a card region of said sheet and oriented to be disposed on an outer surface of a front and a rear card panel of a magnetic strip card to be formed, a siliconized liner patch containing a pressure-sensitive adhesive surface is laminated on a back surface of said carrier sheet and disposed to extend over said card region, a face patch of clear poly material containing a magnetic strip is immovably secured over said card region on said front face of said sheet with said magnetic strip oriented across one of said panels; a die cut delineates said front and rear card panel disposed adjacent one another and extends through said face patch, said magnetic strip and said sheet; said die cut card panels being retained in said sheet by pressure sensitive of said siliconized liner patch, and a straight fold line in said face patch between said front and rear card panels, said magnetic strip card being formable by peeling off said front and rear panels from said carrier sheet with said pressure-sensitive adhesive releasing form said siliconized liner patch whereby said adhesive lies on a back face of said front and rear card panels, and folding said panels along said straight fold line to secure said back face of said panels containing said pressure-sensitive adhesive together.

* * * * *